US006256929B1

(12) United States Patent
Serrano et al.

(10) Patent No.: US 6,256,929 B1
(45) Date of Patent: Jul. 10, 2001

(54) SIMPLIFIED WINDOW-RAISER

(75) Inventors: Felipe Barrero Serrano; Francisco Javier Martinez Moral, both of Burgos (ES)

(73) Assignee: Grupo Antolin-Ingenieria S.A., Burgos (ES)

( * ) Notice: Subject to any disclaimer, the term of this patent is extended or adjusted under 35 U.S.C. 154(b) by 0 days.

(21) Appl. No.: 09/509,679

(22) PCT Filed: Jul. 30, 1999

(86) PCT No.: PCT/ES99/00246

§ 371 Date: Jun. 14, 2000

§ 102(e) Date: Jun. 14, 2000

(87) PCT Pub. No.: WO00/09354

PCT Pub. Date: Feb. 24, 2000

(30) Foreign Application Priority Data

Jul. 30, 1998 (ES) ..... 9801622

(51) Int. Cl.[7] ..... E05F 11/48
(52) U.S. Cl. ..... 49/352
(58) Field of Search ..... 49/348, 349, 352, 49/502

(56) References Cited

U.S. PATENT DOCUMENTS

| | | | | |
|---|---|---|---|---|
| 2,987,937 | | 6/1961 | Sala . | |
| 4,338,747 | | 7/1982 | Hess et al. . | |
| 4,889,007 | * | 12/1989 | Senft et al. | 49/352 X |
| 5,074,077 | | 12/1991 | Toyoshima et al. . | |
| 5,890,321 | * | 4/1999 | Staser et al. | 49/352 X |
| 6,038,817 | * | 3/2000 | Scheck et al. | 49/352 |

FOREIGN PATENT DOCUMENTS

| | | |
|---|---|---|
| 31 36 890 | 4/1983 | (DE) . |
| 85 05 490 | 5/1985 | (DE) . |
| 0 653 538 | 5/1995 | (EP) . |
| 2 089 950 | 10/1996 | (ES) . |

* cited by examiner

*Primary Examiner*—Jerry Redman
(74) *Attorney, Agent, or Firm*—Browdy and Neimark

(57) ABSTRACT

A window winder having a rail cable and motor. The motor drives the cable along the rail to move a window pane engaged on the cable. The rail (1) has a mounting on which a motor casing which houses the motor can be adjusted to a selected position and then securely fixed to the mounting. The motor that operates the cable is also fixed to the casing.

5 Claims, 1 Drawing Sheet

SIMPLIFIED WINDOW-RAISER

BACKGROUND OF THE INVENTION

1. Technical Field of the Invention

This invention relates to a simplified window winder device applicable for raising or lowering the window pane in the doors of automobile vehicles.

2. Prior Art

Window winder devices are known that include several items, such as the guide slide, manual or electric drive, spirals, nozzles, tension adjuster springs, etc, of the Bowden system, cable direction changing units, units for securing the device to the vehicle, etc. In these known window winder devices, the components described are usually incorporated during the assembly of the devices into the door of the vehicle.

All this is a great disadvantage as it means an additional cost, which is substantial in the economic calculation of the device, not only from the point of view of storage and transport but also in other stages of its life.

OBJECT OF THE INVENTION

One object of this invention is to provide a window winder device that totally integrates the cable direction changing items and also the items for securing the system to the rest of the vehicle in one single part.

Another object of the invention is to provide a window winder device that includes the drive motor in such a way that it enables the elimination of the different components of the Bowden system, such as spirals, nozzles and tension adjuster springs, all of which results in the greater economy of the system.

Another object of the invention is to provide a window winder device that, by integrating different items into the assembly itself, achieves a substantial reduction in costs, both in storage and transport and in other stages of the life of the device, manufacture, assembly or repair.

SUMMARY OF THE INVENTION

In order to achieve these objectives of the invention, the simplified window winder device is composed of three fundamental parts, which are:

- A plastic rail, with the cable direction changing systems, the supports between the system and the rest of the vehicle and a special portion to suitably receive the motor for the system, all of which is carried out in one single constituent part.
- A slide that acts as the union between the window winder device and the window pane in the door of the vehicle.
- A motor casing that, while connected to the system motor itself, is also used for positioning the said motor in the rail and for tightening this system, when it is situated on the special portion of the rail.

Apart from this, the window winder device has a cable suitably arranged in the rail for the movement of the window pane secured and moved by the slide.

The rail is an elongated longitudinal item at whose ends are situated the necessary devices in order to procure the change of direction of the cable which has to make the window pane holder slide circulate or move along it. Besides this, the rail itself contains the items for securing the rail to the door or to the rest of the vehicle, as well as a special projecting portion for housing the motor.

This special portion has a hole through it in the portion closest to its end when starting from the rail itself and two concentric curved cut-outs or slots of different diameters housed distinctly in relation to the position of the said hole, which for all effects acts as the pivotal centre in relation to the two slots.

The cut-out with the larger diameter is provided with a toothed or serrated area in its interior which, as will be explained later, is used in order to maintain the angular position desired of the motor during the assembly of the window winder device.

The electric motor to drive the slide by means of the corresponding cable is connected, in accordance with the invention, to a special casing. This casing, made of plastic material, is joined to the motor by means of two bolts that each pass through holes in the body of the said plastic casing.

In the same way, the casing has another three holes through which the corresponding two bolts pass through that will circulate along the larger cut-out in the projection from the rail and a third which, by means of another screw, will occupy the position of the hole in the projection from the rail closest to the said rail, thus performing the functions of the pivotal centre point.

In the centre of the plastic casing, approximately, another hole is provided, together with its corresponding bolt, which coincides in position with the hole in the smaller cut-out in the special projection from the rail.

At the opposite end of the pivotal centre of the plastic casing and between the two bolts in the casing that move in the larger cut-out, a toothed plastic spring is provided that forms a single unit with the casing, and which makes contact with the toothed interior that the larger cut-out on the rail is equipped with.

Once the motor has been fixed to this plastic casing, the motor and plastic casing assembly is presented over the projection from the rail in such a way that the larger cut-out of this projection coincides with the corresponding bolts, the smaller cut-out coincides with the central bolt in the casing and the end bolt coincides with the circular hole in the projection from the rail.

At the same time, the correspondence between the toothed part of the projection in the larger cut-out is carried out appropriately during assembly, so that once the angular position desired has been achieved by turning the casing suitably on the cut-outs, the said correspondence between the toothed areas allows the said angular position to be maintained while the tightening of the bolts corresponding to the projection from the rail is carried out, so as to completely fix the position of the motor and casing on

BRIEF DESCRIPTION OF THE DRAWINGS

All the details and advantageous particularities of the window winder device in accordance with the invention will be appreciated more clearly by referring to the sheet of drawings which is attached, in which the following are represented for informative purposes only.

DETAILED DESCRIPTION OF THE PREFERRED EMBODIMENT(S) OF THE INVENTION

Figure 1:
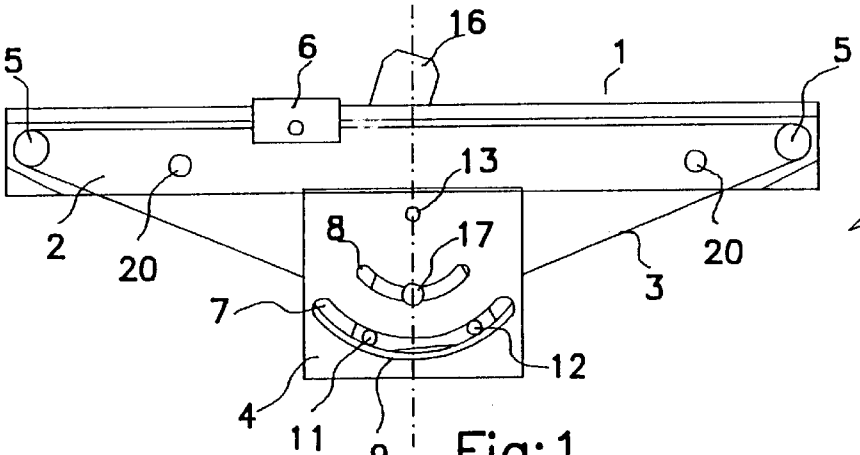
FIG. 1 is an elevation of the plastic rail in accordance with the invention.

Looking now at FIG. 1, it is possible to appreciate the rail (1) in accordance with the invention, preferably made of plastic material, which is a single part that includes a guide area (2) for the window pane holder slide (6) with the devices (5) for changing the direction of the cable, supports (20) for securing or fixing the rail (1) to the vehicle and a mounting projection (4)

In FIG. 1, we can also observe the cable (3), which is operated by the motor (15), and the slide (6), which is connected to the cable and incorporates the window pane for the door.

In the mounting (4) it is necessary to mention the hole (13) close to the guide (2) for the rail and the two concentric cut-outs (8, 7) that have their common centre at the previously mentioned position (13). The larger cut-out (8) has the previously mentioned toothed area (9) in its interior.

Figure 2:
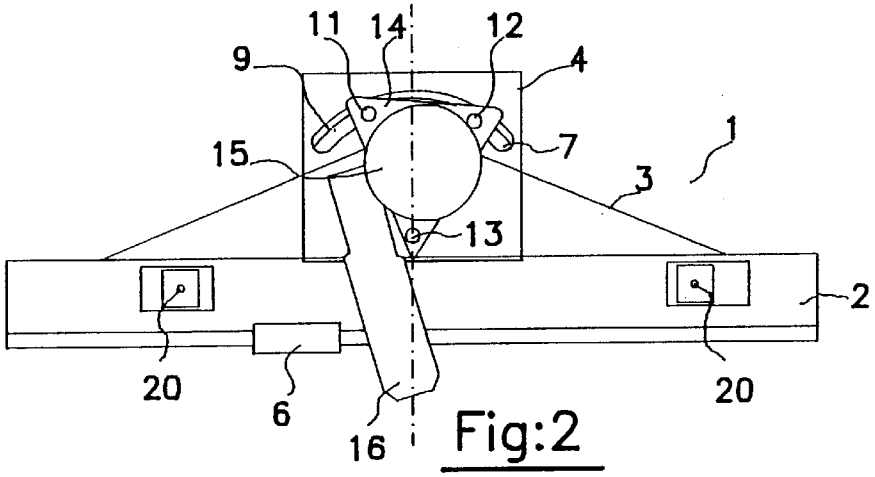
FIG. 2 is another elevation corresponding to the opposite side of the rail shown in FIG. 1.

According to FIG. 2, we can observe the items previously mentioned, with the presence of the motor (15, 16) arranged on the mounting projection (4) by means of the plastic casing (14) secured to the said projection, as well as the path of the cable (3) operated by the motor.

Figure 3:
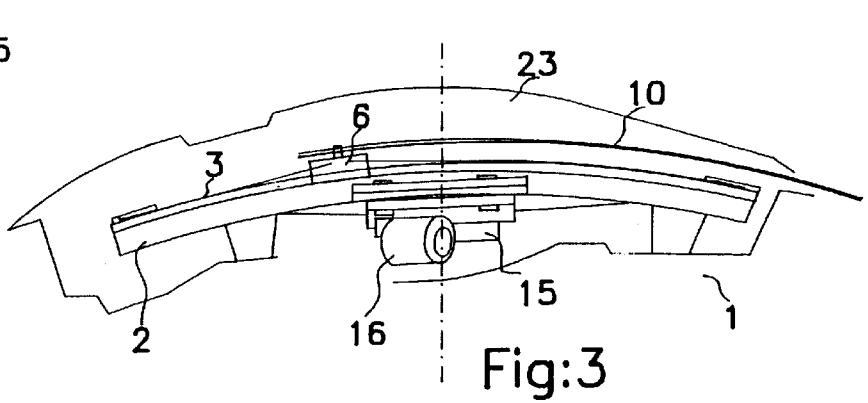
FIG. 3 is a bottom view of FIG. 1.

FIG. 3 emphasises the relationship between the assembly in the invention and the rest of the vehicle (23), as well as the window pane (10) connected to the slide, which moves inside the door of the vehicle when the motor (15, 16) operates the cable (3) and moves the slide (6).

Figure 4:
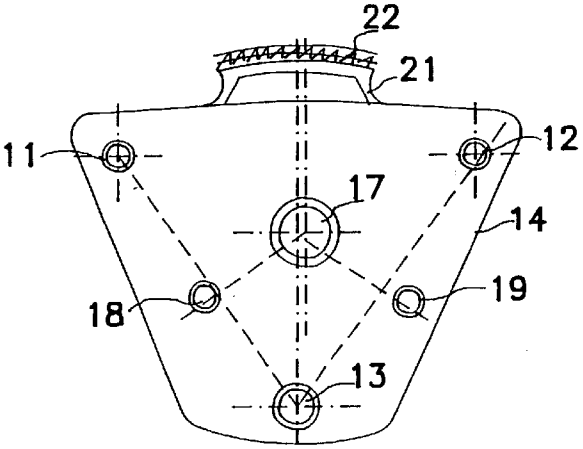
FIG. 4 is a plan-view of the plastic casing.

In accordance with FIG. 4, the plastic casing (14) is equipped with holes (18, 19) through which the motor (15, 16) is fixed to the casing. A shaft, which can also be observed in FIGS. 1 and 2, passes through the lower hole (13). The casing with the motor on the projection (4) can turn on this shaft.

By means of the bolts in the positions (11, 12), the casing (14) can slide in the larger cut-out (7) in the projection (4) from the plastic rail (1) and by means of the central bolt (17) can slide in the smaller cut-out (8) until the said bolts are completely tightened.

Therefore, on placing the plastic casing (14) on the projection (4), the casing-motor assembly can turn on the point (13) in order to achieve any angular position. However, as the casing (14) is provided with the toothed (22) plastic spring (21) between the positions of the two bolts (11, 12), it happens that this toothed part (22) makes contact with the toothed area (9) of the larger cut-out (7) of the projection (4), so that once the exact convenient angular position of the motor has been achieved as regards its correct tightening in relation to the cable (3) and the slide (6), the connection between both toothed areas maintains this position until the bolts (11, 12, 17) are properly screwed down to the rail, thus preventing any displacement from the desired position, all of which is illustrated in FIGS. 1 and 2.

In this way, the window winder device described has a configuration such that, by having the motor integrated, it allows the elimination of the different items of the Bowden system—spirals, nozzles and tension adjuster springs—as already mentioned previously, all of which results in the greater economy of the system.

The different items in the system can be joined together by welding, riveting, bolting, adhesives or any other means of connection available.

It is also possible to make the different integrated items of different materials or of different thicknesses, thus achieving improvements with regard to the absorption of energy in the event of side impacts and a greater control of the rigidity of the structure.

What is claimed is:

1. A window winder device adapted to be mounted on a door of a vehicle having a window pane, the device comprising:

a rail (1) having a mounting projection (4), the mounting projection (4) having a shaft and two circular cut-outs (7, 9), a first cut-out of the two circular cut-outs having a toothed area (9);

a casing (14);

a drive motor fixed to the casing;

a cable (3) having a slide (6) driven by the motor to move the slide (6) along a length of the rail (1);

the casing (14) having at least two holes and a toothed plastic spring (22) respectively corresponding in location to the first cut-out;

a third hole to receive the shaft and a fourth hole corresponding in location to a second cut-out of the two circular cut-outs;

wherein when bolts are inserted through the two holes and the first cut-out and through the fourth hole and second cut-out and the shaft is engaged in the third hole, the casing can be rotated to a selected position on the mounting projection (4) and the bolts tightened to engage the toothed plastic spring (22) to the toothed area (9) in the selected position.

2. The window winder device according to claim 1, wherein the rail (1) has means (5) for changing a direction of the cable (3) from the drive motor to that along the length of the rail (1).

3. The window winder device, in accordance with claim 1, wherein the casing and the slide are made of plastic material.

4. The window winder device, in accordance with claim 1, wherein different items comprising the device can be joined to each other by conventional means.

5. The window winder device, in accordance with claim 4, the different items including the rail, the casing and the slide are made of different materials and of different thicknesses.

* * * * *